US006332464B1

(12) United States Patent
Chen

(10) Patent No.: US 6,332,464 B1
(45) Date of Patent: Dec. 25, 2001

(54) SCUBA DIVING REGULATOR

(76) Inventor: Frankie Chen, 4F, No. 20, Ln. 46, Shin-Tung Rd., Taipei (TW)

( * ) Notice: Subject to any disclaimer, the term of this patent is extended or adjusted under 35 U.S.C. 154(b) by 0 days.

(21) Appl. No.: 09/397,520

(22) Filed: Sep. 17, 1999

(51) Int. Cl.[7] ..... A61M 16/00; A62B 7/04; F16K 31/26

(52) U.S. Cl. ..... 128/204.26; 128/201.19; 128/201.27; 128/201.28; 128/205.24

(58) Field of Search ..... 128/204.26, 201.19, 128/201.27, 201.28, 205.24; 405/186; 116/27, 142; 181/121; 441/89, 96

(56) References Cited

U.S. PATENT DOCUMENTS

| | | | | |
|---|---|---|---|---|
| Re. 36,223 | * | 6/1999 | Schuler | 128/205.24 |
| 4,095,667 | * | 6/1978 | Mahig et al. | 181/120 |
| 4,852,510 | * | 8/1989 | Joseph, Jr. et al. | 116/140 |
| 4,998,499 | * | 3/1991 | Nordbeck | 116/142 |
| 5,259,375 | * | 11/1993 | Schuler | 128/205.24 |
| 5,302,055 | * | 4/1994 | Johnston | 405/186 |
| 5,520,485 | * | 5/1996 | Hermansen | 405/186 |
| 5,788,415 | * | 8/1998 | Chen | 405/186 |
| 6,007,049 | * | 12/1999 | Wass et al. | 251/368 |

* cited by examiner

*Primary Examiner*—John G. Weiss
*Assistant Examiner*—Darwin P. Erezo
(74) *Attorney, Agent, or Firm*—Dougherty & Troxell

(57) ABSTRACT

A scuba diving regulator includes a casing, a mouth piece, an air valve unit, an audio unit, a nozzle unit, an air charge unit and an air discharge unit. The casing has an alarm connector, a whistle connector linearly aligned with the alarm connector and a mouth piece connector for engaging with the mouth piece. The casing includes therein a longitudinal chamber adjacent a body. The air valve unit engages with the alarm connector and includes an alarm valve, an elastic member and a push button engaged with the elastic member for open or close the alarm valve. The audio unit engages with the whistle connector and includes a cylinder, an impact member located in the cylinder and a piston reciprocally movable in the cylinder for hitting the impact member to produce audio alarm sound. The nozzle unit is held in the casing and is screwed and sealed in the chamber by means of the screw member and a seal ring, and includes an air flow member which engages with the alarm valve. The air charge unit is mounted on the casing and includes a charge button reciprocally movable in the body, a seal ring, an elastic member engageble with the charge button and a charge valve engaged with the air flow member. The discharge unit is mounted on the casing and includes a discharge button reciprocally movable in the body and and an elastic member engagable with the discharge button.

3 Claims, 3 Drawing Sheets

SCUBA DIVING REGULATOR

FIELD OF THE INVENTION

This invention relates to a scuba diving regulator and particularly to an easy to use scuba diving regulator that may charge and discharge air simply and produce audio alarm below and above water surface.

BACKGROUND OF THE INVENTION

Among the scuba diving devices now being generally used, there is an air tank to contain compressed air. There is also a buoyancy compensator jacket which may communicate with the air tank through an air hose. The air hose has a charge valve and a discharge valve for controlling air charging or discharging to adjust the buoyancy of the jacket.

An alarm device also often being included in the diving device. It may produce audio sound to alert an emergency situation and call for help. Conventional alarm devices use compressed air to repeatly produce pressure difference at two opposite sides of a membrane for generating vibration to produce audio sound to gain other people's attention.

However when a diver dives below water surface, sea water enters into the chamber and speaker of the alarm device making the vibration resulting from air pressure difference not functionable. Hence such alarm devices may only be used above water surface. It is useless below water surface.

There are many situations divers need help when diving under water surface such as physical exhaustion, body disorder, threatening by harmful seal animals or shark and the like. If a diver cannot get quick attention and help from other divers nearby, it could result in serious danger or even lose life. There is a great need for better alarm devices that can work effectively both above and under water surface.

SUMMARY OF THE INVENTION

It is an object of this invention to provide a scuba diving regulator that may produce audio alarm above and below water surface to alert other people's attention. It also has simple structure and small size to facilitate carrying and use. The regulator may be used with the air tank and buoyancy conpensator jacket or vest. A user may single-handedly operate for charging air, discharging air or producing alarming sound for help.

The structure is streamline and may reduce water resistance, and may reduce production and installation costs.

The scuba diving regulator according to this invention includes a casing, a mouth piece, an air valve unit, an audio unit, a nozzle unit, an air charge unit and an air discharge unit.

The casing includes an alarm connector, a whistle connector linearly aligned with the alarm connector, a mouth piece connector, a longitudinal chamber and a body.

The air valve unit engages with the alarm connector and includes a push button, an elastic member embedded in the push bottom and an alarm valve which may opened or closed by pressing the push button.

The audio unit engages with the whistle connector and includes an air cylinder, a piston reciprocally movable in the cylinder and an impact member able to generate alarming sound when hit by the piston.

The nozzle unit engages with the casing and includes an air flow member, a plurality of seal rings and a screw member. The seal rings serve to seal and hold the nozzle unit, and the screw is to screw the nozzle unit in the chamber. The air flow member engages with the alarm valve.

The air charge unit engages with the casing and includes a charge button, a seal ring, an elastic member and a charge valve which is held on the air flow member. The charge button is reciprocally movable in the body and is sealed by the seal ring and engages with the elastic member.

The air discharge unit engages with casing and includes a discharge button reciprocally movable in the body and an elastic member engageable with the discharge button.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
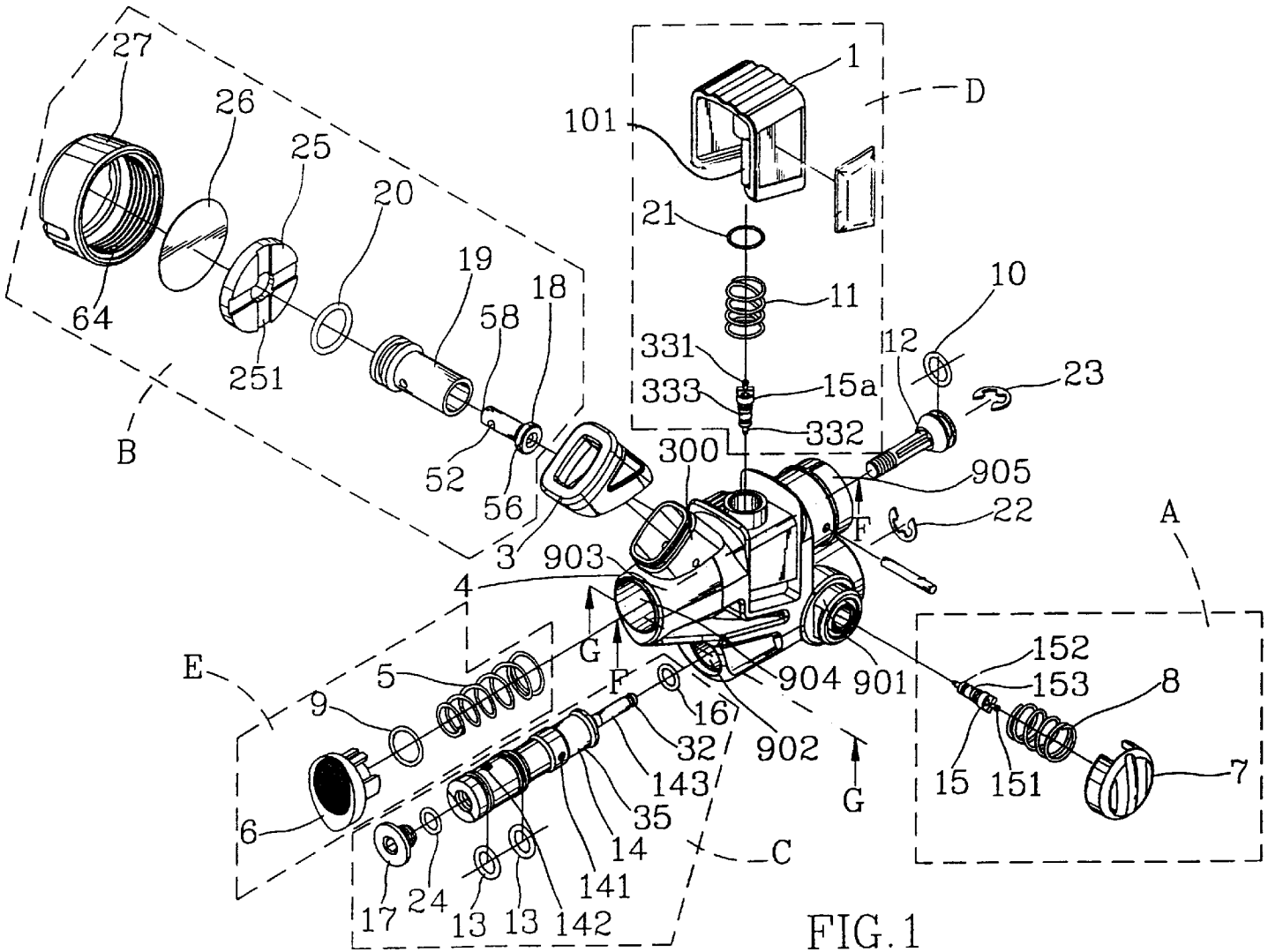
FIG. 1 is an exploded perspective view of this invention.

Referring to FIG. 1, the scuba diving regulator according to this invention includes an air valve unit A, an audio unit B, a nozzle unit C, an air charge unit D, an air discharging unit E, a mouth piece 3 and a casing 4.

The casing 4 has a plurality of space to accommodate the air valve unit A, audio unit B, nozzle unit C, air charge unit D, air discharge unit E and the mouth piece 3 to form an assembly for each unit to perform its function.

There is no restriction on the material to make the units set forth above. The casing 4 may be integrally made by plastic molding process. At one side of the casing 4, there is an alarm connector 901 for engaging with the air valve unit A. At another side of the casing 4, there is a whistle connector 911 for engaging with the audio unit B (shown in FIG. 3). The whistle connector 911 is aligned linearly with the alarm connector 901.

Inside the casing 4, there is a hollow chamber 902 for holding the nozzle unit C. Through an air hose (not shown in the figures) engaging with an air tank (also not shown in the figures) and a compressed air control switch, air may flow into the nozzle unit C.

Adjacent the chamber 902, the casing 4 further has a body 903 which has an opening 904 engaged with an air charge connector 905 which in turn engages with an input end of a flexible hose (not shown in the figures) for communicating with a buoyancy compensator jacket (not shown in the figures).

At one side of the body 903, the air discharge unit E is located. The casing 4 adjacent the air discharge unit E has a mouth piece connector 300 for engaging with the mouth piece 3 above the body 903. The air charge unit D is located between the body 903 and the chamber 902.

The air valve unit A mainly includes a push button 7, an elastic member 8 and an alarm valve 15. The push button 7 may be made of rubber or plastic and engages with one end of the elastic member 8 (could be a spring) to form a button cap to engage with the alarm connector 901 and is located outside the casing 4. The alarm valve 15 is located in an alarm valve cavity 141 in the nozzle unit C. The alarm valve 15 has a valve stem 151 which has one end making contact with the push button 7 through the elastic member 8.

The elastic member 8 is embedded in the push button 7 for opening a valve plug 152 of the alarm valve 15. Under normal situations, the valve plug 152 closes an air passage 153 located in the alarm valve 15. The air passage 153 communicates with the nozzle unit C, the air opening in the alarm connector 901, the chamber 902 of the nozzle and another air opening located at one side of the whistle connector 911.

The audio unit B includes a piston 18, a shock guard ring 20, a fixing block 25, a cap 27, an impact member 26 and a cylinder 19. The impact member 26 is mounted in the whistle connector 911 by means of the shock guard ring 20 and is located within the cap 27. The shock guard ring (or an O-ring) 20 is located between the cylinder 19 and the casing 4 for preventing air leaking. The impact member 26 is a thin and rigid metallic disk held in front of the cylinder 19 by the cap 27 which has screw threads 64 for engaging with the casing 4. However there are gaps 66 purposefully formed between the cap 27 and the casing 4 and in the screw threads 64.

The fixing block 25 has a cross shape groove 251 and is fixedly located between the impact member 26 and the cylinder 19 and is held in the cap 27. Compressed air in the discharge chamber 72 may seep and escape out through the fixing block 25, the contact area between the impact member 26 and the front end of the cylinder 19, and through the gaps 66.

The piston 18 is substantially a "T" shape cylindrical member which has a radial through hole 52 and an axial air passage 54 leading from the through hole 52 to one end of the piston to form a "T" shape air flow path. The cylinder 19 is a hollow tubular member for housing the piston 18 therein. The piston 18 is reciprocally movable in the cylinder 19.

Figure 3:
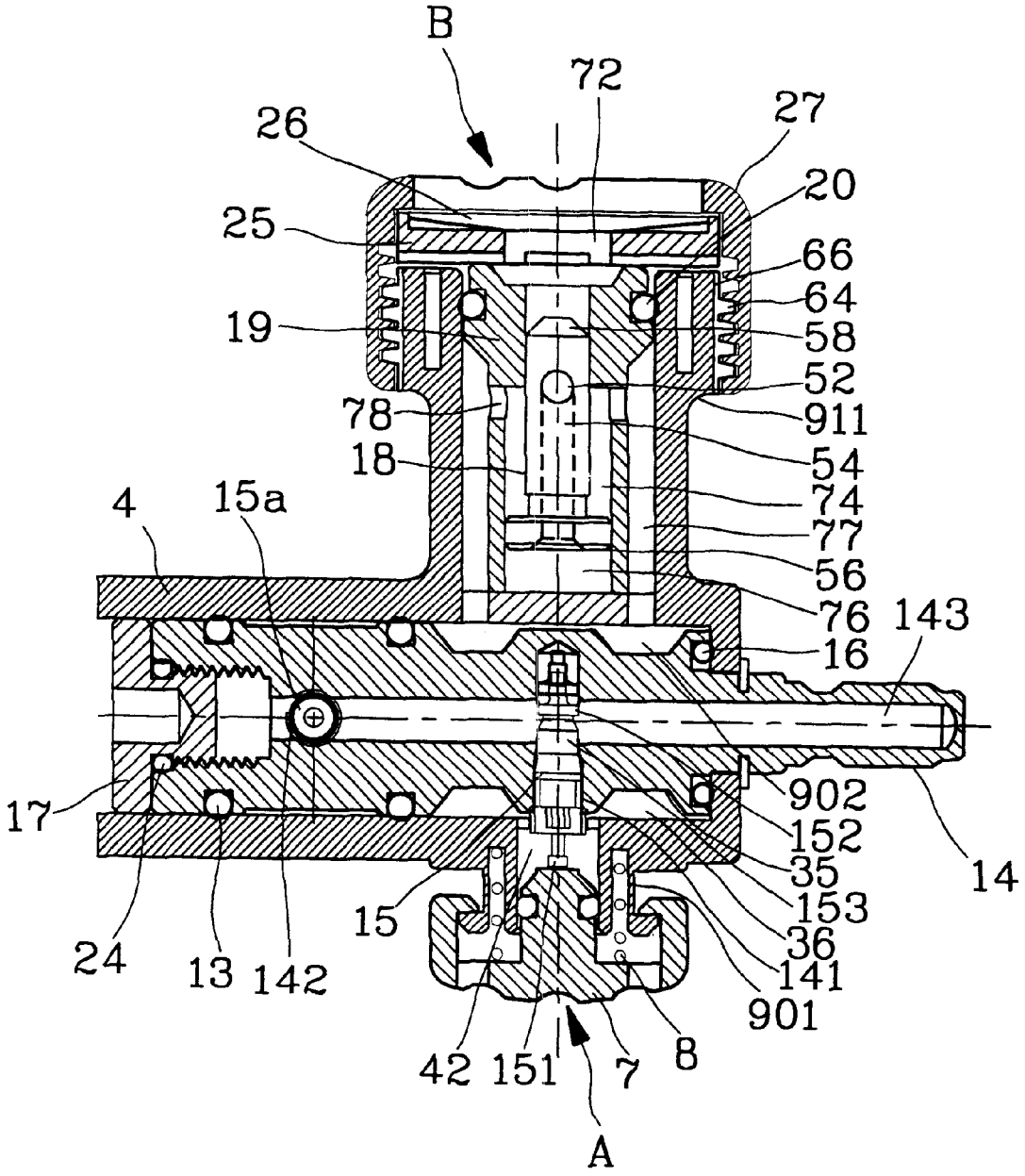
FIG. 3 is a sectional view taken on line G—G in FIG. 1.

Referring to FIG. 3, the interior space of the cylinder 19 may be divided in three separate air chambers depending on the piston location. The discharge chamber 72 is located in front of the front end 58 of the piston, a rear air chamber 76 is located behind a piston rear end 56 and a front air chamber 74 is located between the discharge chamber 72 and the rear air chamber 76. Because the piston 18 has close contact with the inside wall of the cylinder 19, the chambers 72, 74 and 76 do not communicate with each other directly.

The outer wall of the cylinder 19 has a plurality of holes 78 formed for communicating with an outer passage 36 located outside of the air flow member 14 and with the front air chamber 74 so that compressed air may flow from the outer passage 36 into the front air chamber 74 to push the piston 18 move rearward toward the piston end 56.

The nozzle unit C mainly includes a seal ring 16, a snap ring 22, the air flow member 14, seal rings 13 and 24, and a screw bolt 17. The air flow member 14 has an center hole 143 axially formed therein to engage with a charge valve cavity 142 at one end and an alarm valve cavity 141 at another end.

The charge valve cavity 142 may engage with the charge valve 15*a* of the air charge unit D. The alarm valve 141 may engage with the alarm valve 15 of the air valve unit A.

At a top end of the air flow member 14, there is a nozzle connector 32 (may be a male coupler for a fast connector) for engaging with an air hose connecting with the air tank for supplying compressed air. In the connector 32, a filter may be provided to prevent external articles from entering into the nozzle unit C. At a bottom end of the air flow member 14, another connector(female type) may be provided for engaging with other diving gears (not shown in the figures).

On the circumference of the air flow member 14, at least one ditch groove 35 is formed for communicating with the chamber 902, alarm connector 901 and whistle connector 911 to form the outer passage 36 for compressed air to perform alarming function.

The alarm valve 15 engages with the alarm valve cavity 141 for controlling air flow between the center hole 143 and the outer passage 36. The seal ring 13 seals between the air flow member 14 and the casing 4 for preventing compressed air from leaking.

The nozzle unit C engages with the casing 4 by means of the snap ring 22 and seals with the casing by means of the seal ring 16. The screw member 17 is located in the nozzle unit C and also is sealed with the casing 4 by means of the seal ring 24. The screw member 17 is used for charging air to any devices and equipments that need air charging, both above or below water surface.

The air charge unit D mainly includes a charge button 1, a seal ring 21, an elastic member 11 and the charge valve 15*a*. The charge button 1 engages with a charge bar 101 which further is surrounded by the elastic member 11. Both the charge button 1 and the charge bar 101 are reciprocally movable in the body 903. The seal ring 21 is to seal the charge button 1 against the body 903.

The charge valve 15*a* has a valve stem 331 making contact with one end of the charge bar 101 and a valve plug 332 which closes an air passage 333 in the charge valve 15*a* at normal time. The air passage 333 communicates with the nozzle unit C, body 903 and an opening 904 in the body 903. When the charge button 1 is actuated to open the valve plug 332, compressed air in the air tank may flow into the buoyancy compensator jacket to adjust the diver's buoyancy in the water or at water surface.

The air discharge unit E mainly includes a discharge button 6, seal rings 9 and 10, an elastic member 5, a discharge bar 12 and a snap ring 23. The discharge button 6 engages with the discharge bar 12 reciprocally movable in the body 903. The seal ring 9 seals the discharge button 6 against the body 903. The snap ring 23 engages with the discharge bar 12 for holding it in the body 903. The elastic member 5 (may be a restoring spring) is held in the body 903 and has one end engaged with the discharge button 6. The seal ring 10 is for sealing the discharge bar 12 at another end against the body 903 for preventing leaking.

Figure 2:
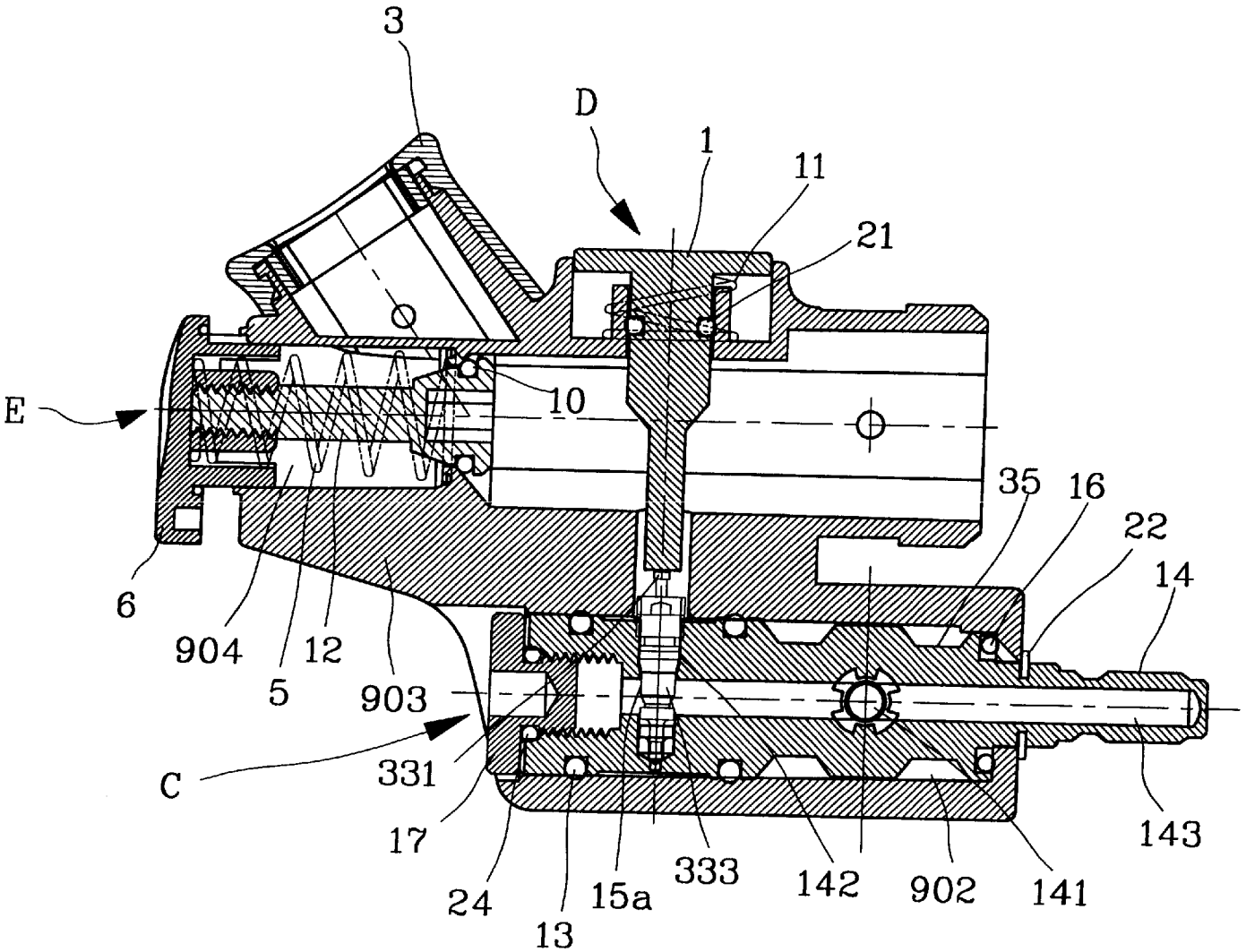
FIG. 2 is a sectional view taken on line F—F in FIG. 1.

Pressing the discharge button 6, the discharge bar 12 will be moved, air in the buoyancy compressor jacket may be discharged out for lowering the buoyancy of the jacket in the water (referring to FIG. 2).

Pressing the charge button 1, the elastic member 11 helps to open the valve plug 332 in the charge valve 15*a*, compressed air in the air tank flows from the air hose, through the center hole 143, air channel 333, opening 904 and flexible hose into the buoyancy compensator jacket to adjust diver's buoyancy in water or at water surface.

Referring to FIG. 3, between the alarm valve 15 and push button 7, there is a first guide passage 42 communicating with the outer passage 36. Pressing the push button 7, the elastic member 8 helps to open the valve plug 152 in the alarm valve 5, compressed air in the center hole 143 flows from the alarm valve 15, through the first guide passage 42 into the outer passage 36.

Because of the movement of the piston 18, the through hole 52 in the piston 18 communicates with the front air chamber 74. Compressed air flows through the through hole 52 and air passage 54 into the rear air chamber 76. When external force is absent, the push button 7 will be automatically pushed back to its initial position to close the alarm valve 15.

When air flows in the rear air chamber 76, the pressure in the piston end 56 is greater than that in the piston head 58, compressed air thus pushes the piston 18 forward toward the direction of the piston head 58. The through hole 52 communicates with the discharge chamber 72. The impact member 26 is hit by the piston 18 to produce audio sound.

When the through hole 52 communicates with the discharge chamber 72, compressed air in the rear air chamber 76 flows through the air passage 54, through hole 52 to the discharge chamber 72, and through the gap 66 around the impact member 26 to be discharged out. Air pressure in the rear air chamber 76 will then drop.

The gap between the cylinder 19 outside wall and the casing 4 forms a second guide passage 77. Compressed air in it will continue flow into the front air chamber 74 and moves the piston 18 rearward again for another cycle of reciprocal motion.

Therefore, by pressing the push button 7 to continue supply compressed air, the piston 18 may be driven to move reciprocally in the cylinder 19 and hit the impact member 26 repeatedly to produce a series of audio sound to gain other people's attention.

As this invention generates audio sound by means of hitting impact, it works equally well above water or under water surface. Thus it effectively resolves the problem of conventional alarm devices which cannot make sound below water surface.

The cylinder 19 of this invention is simply structured and may be integrally formed and held in the casing 4. The regulator size may be reduced. Production and installation costs may also become lower.

The air charge unit D, air discharge unit E and mouth piece 3 may also be integrally formed with the casing 4 to make the whole regulator compact size and easy to use. The overall structure is also streamlined and ergonomical, and may reduce water resistance and enhance maneuverability when use in water.

It may thus be seen that the objects of the present invention set forth herein, as well as those made apparent from the foregoing description, are efficiently attained.

What is claimed is:

1. A scuba diving regulator, comprising:

a casing including an alarm connector, a whistle connector, a mouth piece connector, and a chamber longitudinally located inside, the alarm connector being linearly aligned with the whistle connector;

a mouth piece mounted on the mouth piece connector;

a nozzle unit located in the casing including an air flow member with a longitudinal center hole;

an air valve unit engaged with the alarm connector and including a push button, a first elastic member engaged with the push button and an alarm valve having one end engaged with the push button, the alarm valve extending into the air flow member transverse to the longitudinal center hole so as to be movable between open and closed positions, the first elastic member biasing the alarm valve to the closed position;

an audio unit engaged with the whistle connector and including: a cylinder mounted in the whistle connector, a portion of the cylinder being spaced from the whistle connector so as to define a guide passage therebetween, the cylinder having an inner chamber; a piston mounted in the inner chamber so as to be movable between first and second positions, the piston dividing the inner chamber into front and rear air chambers and having a radial through hole in communication with an axial passage which, in turn, communicates with the rear air chamber, the piston having a front end; a fixing block having a plurality of grooves communicating with a central hole; an impact member adjacent to the fixing block and extending across the central hole such that the piston, when in the second position contacts the impact member thereby producing an audible sound; a discharge chamber including the central hole and plurality of grooves communicating with an exterior of the casing, whereby, when the alarm valve is moved to the open position, air from the center hole of the air flow member passes into the guide passage, through holes in the cylinder into the rear air chamber and, via the radial through hole and axial passage in the piston, into the front air chamber to move the piston to the second position in which the radial through hole communicates with the discharge chamber to reduce air pressure in the front air chamber, thereby enabling air in the rear air chamber to return the piston to the first position;

an air charge unit mounted on the casing including a charge valve engaged with the air flow member, a charge button reciprocally movable in the casing and engaged with the charge valve for opening or closing the charge valve, and a second elastic member engaged with the charge button; and a discharge unit located in casing and including a discharge button reciprocally movable and a third elastic member engaged with the discharge button.

2. The scuba diving regular of claim 1, wherein the alarm valve comprises a valve stem engaged with the push button through the first elastic member and a valve plug sealing an air passage formed in the alarm valve through the first elastic member, the air passage communicating with the guide passage.

3. The scuba diving regulator of claim 1, wherein the air flow member has at least one groove formed around an outside circumference thereof, a charge valve cavity adjacent one end receiving the charge valve and an alarm cavity receiving the alarm valve.

* * * * *